United States Patent [19]

Orlita

[11] Patent Number: 4,531,897

[45] Date of Patent: Jul. 30, 1985

[54] PISTON PUMP WITH A ROTATING PISTON

[76] Inventor: Franz Orlita, Waldstrasse 33, D-6305 Buseck-Alten Buseck, Fed. Rep. of Germany

[21] Appl. No.: 570,174

[22] Filed: Jan. 12, 1984

[30] Foreign Application Priority Data

Jan. 13, 1983 [DE] Fed. Rep. of Germany ..... 3300847

[51] Int. Cl.[3] ..... F04B 9/04

[52] U.S. Cl. ..... 417/500; 74/41; 74/49; 74/22 R

[58] Field of Search ..... 417/500, 492; 74/22 R, 74/47, 49; 123/45 R, 449; 91/233; 92/31

[56] References Cited

U.S. PATENT DOCUMENTS 3,168,872 2/1965 Pinkerton ..... 417/500 X
3,382,812 5/1968 Smith ..... 417/500

FOREIGN PATENT DOCUMENTS 509222 10/1930 Fed. Rep. of Germany .
624242 7/1927 France ..... 417/500
981580 5/1951 France ..... 417/500

*Primary Examiner*—Leonard E. Smith
*Attorney, Agent, or Firm*—Flynn, Thiel, Boutell & Tanis

[57] ABSTRACT

A piston pump with a rotating piston is driven by a motor. A crank is provided on the motor shaft and has a first rolling surface on its front side. A further rolling surface engages the first rolling surface, the further rolling surface being provided on an arm which is connected fixedly to the pump piston. In one preferred embodiment, the crank is coupled with the piston in such a manner that a projection on a part connected fixedly with the piston engages a recess in the crank. An arrangement is provided for maintaining the contact between the rolling surfaces during the suction stroke of the pump. The piston controls an inlet opening and an outlet opening to the chamber in which it is movably supported. The transmission of forces during the discharge stroke through surfaces which roll on one another results in a long lifetime of the pump and quiet running.

27 Claims, 8 Drawing Figures

PISTON PUMP WITH A ROTATING PISTON

FIELD OF THE INVENTION

The invention relates to a piston pump and, more particularly, to a pump having a rotatable piston which is movable back and forth in a cylindrical bore, and having a rotatable crank to which the piston is operatively coupled, the piston axis and the axis of rotation of the crank intersecting one another.

BACKGROUND OF THE INVENTION

Pumps of this type have a very simple gearing, since the pump stroke is obtained by the inclination between the crank axis and piston axis. The crank and piston are typically connected by a connecting rod. During the course of one rotation of the crank, the angles which the connecting rod defines on the one hand with the crank and on the other hand with the piston change. For this reason, in conventional pumps the connecting rod is pivotally connected with the crank and the piston. The joints are susceptible to wear, which can quickly result in play between the connecting rod and its pivot points, which produces excessive noise and also changes the conveying characteristics. Either good lubrication must be provided or else a shorter lifetime must be accepted in such pumps.

Pumps with rotatable pistons have the advantage that they can be constructed as control piston pumps, in which the piston acts as a rotary slide valve. Such pumps have a minimum of movable parts and are extraordinarily robust. In order to assure the rotary slide valve function, the joint between the connecting rod and the piston must be constructed so that angle changes between the connecting rod and piston are possible, but so that the piston is driven for rotary movement with as little play as possible. Through this, special demands are made on the joint.

A basic purpose of the invention is to provide a piston pump of the above-mentioned type in which movements which cause sliding friction are substantially avoided.

SUMMARY OF THE INVENTION

This purpose is attained according to the invention by providing on the piston or a part which is connected rigidly with the piston an annular piston rolling surface which cooperates with a rolling surface provided on the crank, the axes of the annular surfaces being inclined to one another and the rolling surfaces being urged against one another by forces which occur during the discharge stroke along a line or point of contact which, upon rotation of the crank, moves along the annular rolling surfaces. The piston and crank are coupled by an arrangement which transmits forces which occur during the suction stroke from the crank to the piston.

In such a pump, the piston rolling surface rolls, during one rotation of the crank, once around the crank rolling surface, so that little or no slipping takes place therebetween. Through this, the pump lifetime is very substantially increased in comparison to a pump which has a ball joint or the like, even if no lubrication is provided. A joint between the part which has the piston rolling surface and the piston is not needed. It is sufficient if the relatively large forces which effect the discharge stroke are transmitted in this manner. Other means can be provided for the transmission of the forces which effect the suction stroke.

If an adjustable stroke is not provided, the construction of the piston rolling surface as a cone-shaped surface is particularly advantageous. Such a surface can be precisely manufactured at low expense. It is particularly advantageous if both of the cooperating annular rolling surfaces are constructed as conical surfaces, wherein in a particularly advantageous embodiment the cone angles of both conical surfaces are equal. Through this, sliding friction is reduced to a minimum. It is also possible, for a constant piston stroke, to provide a part which is rigidly connected to the piston, extends through an opening in a wall of the crank, and has a flange which engages the back side of the wall. Such an arrangement is particularly reliable and is suitable when the forces acting on the piston during the suction stroke are relatively large. Also, in this case, it is possible to provide conical surfaces to effect the retraction of the piston during the suction stroke.

The connection can also include a spring arrangement which urges the rolling surfaces against one another. In the case of a concentric spring arrangement, the spring can lie within the rolling surfaces or can surround them.

A rotary-drive connection between the crank and piston can be formed by a form-locking engagement of the piston, or a part fixedly connected thereto, with an opening in the crank. However, it is also possible to create a rotary-drive connection using a helical spring which is arranged concentrically with respect to the crank axis and the piston axis.

If the angle between the piston axis and the axis of rotation of the crank is to be variable in order to be able to adjust the piston stroke, spherical and toric surfaces are advantageous.

In pumps for larger strokes, a coupling piece is advantageous. With the help of a screw, the correct orientation of the steering edges of the piston relative to the inlet and outlet openings is achieved.

BRIEF DESCRIPTION OF THE DRAWINGS

Exemplary embodiments of the invention are illustrated in the drawings, in which.

DETAILED DESCRIPTION

Figure 1:
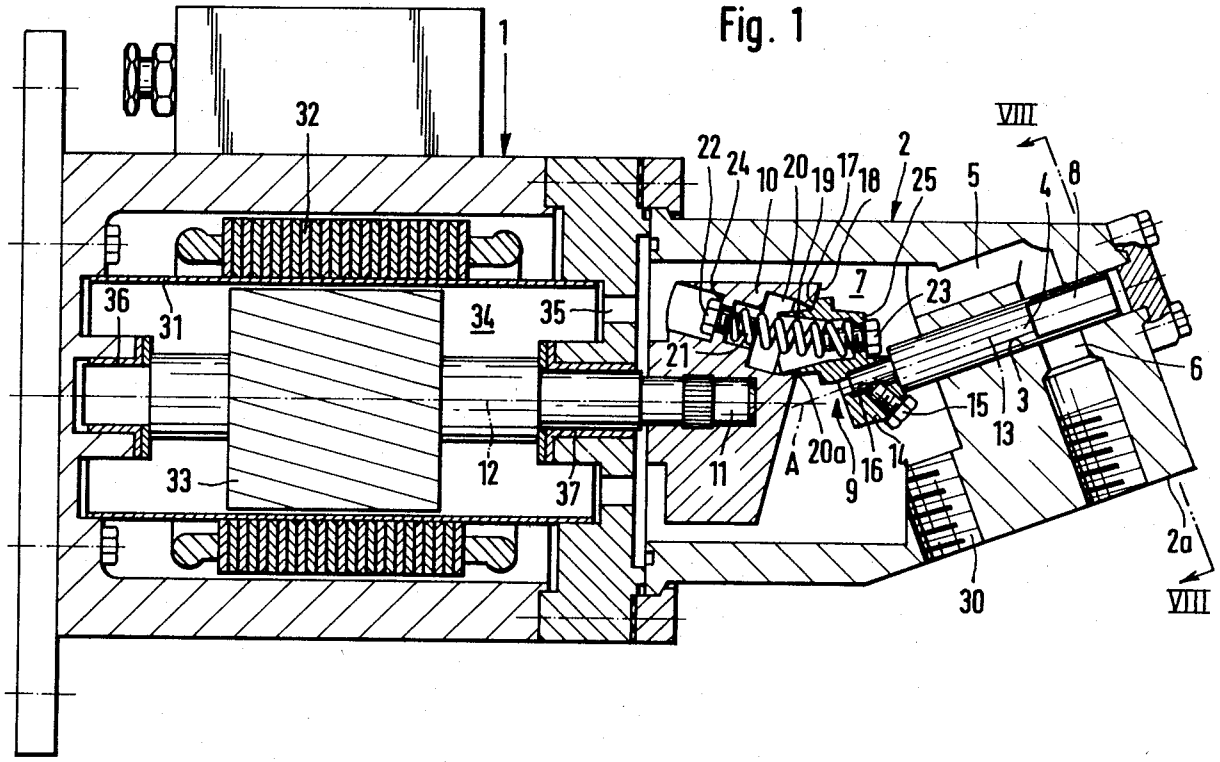
FIG. 1 is a longitudinal sectional side view of a pump embodying the invention and an associated drive motor, and shows piston rolling surfaces which are conical surfaces.

The pump according to FIG. 1 has an electric drive motor 1 and a pump housing 2 attached thereto. A cylindrical bore 3 is provided in the pump housing 2, in which bore is axially slidably supported a generally cylindrical piston 4 which sealingly engages the walls of the bore 3. A suction bore 5 and a discharge bore 6 communicate with the cylindrical bore 3. The suction bore 5 opens into a cavity or chamber 7 within the pump housing 2, while the discharge bore 6 opens through the outer surface 2*a* of the pump housing 2, so that a fluid line can be connected thereto.

Figure 8:
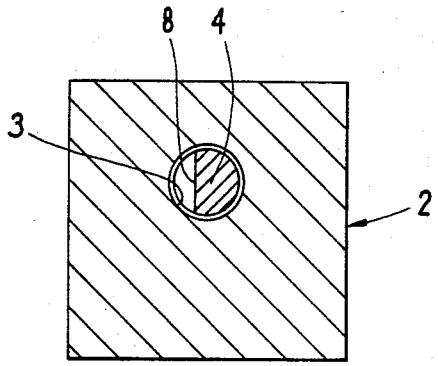
FIG. 8 is a sectional view taken along the line VIII—VIII in FIG. 1.

The piston 4 has an outwardly facing planar surface 8 (FIG. 8) on one side thereof which is axially aligned with the bores 5 and 6 so that, depending on the rotary position of the piston, only one of the suction bore 5 and the discharge bore 6 is communicating with the cylindrical bore 3 at any given time, the other of the bores 5 and 6 being obstructed by the piston 4. Rotation and longitudinal movement of the piston are synchronized with one another so that during the suction stroke (movement of the piston to the left in FIG. 1) the suction bore 5 communicates with bore 3 and during the discharge stroke (movement of the piston to the right in FIG. 1) the discharge bore 6 communicates with the bore 3. This pump principle is known.

New is the coupling arrangement provided to couple the piston 4 with a crank 10, which coupling arrangement is identified as a whole with reference numeral 9. The crank 10 is provided on and fixed against rotation with respect to the shaft 11 of the electrical motor 1. The axis of rotation of the motor shaft 11 and thus of the crank 10 is identified with reference numeral 12. This axis intersects the axis 13 of the piston 4 at point A. The axes 11 and 13 are thus positioned at an angle to one another.

The coupling 9 has an arm 14 which is connected rigidly to the piston 4 by a setscrew 15 which is screwed into a tapped hole in the arm 14 and engages an inclined surface 16 provided in a notch on an axially extending stem of the piston 4. The screw is oriented so that the pressure exerted onto the surface 16 creates a force longitudinally of the piston 4 which urges the crank arm 14 toward the piston.

A conical surface 17 is provided on the crank arm 14 and engages a flat front surface 18 which is provided on the crank 10 and is arranged at an angle with respect to the axis 12. The cone angle of the conical surface 17 and the slope of the front surface 18 of the crank 10 are chosen so that the conical surface 17 always engages the flat surface 18 along a line of contact.

The arm 14 has an axially extending annular projection 19 thereon which is disposed in a cavity 20 provided in the crank 10. The cavity 20 has a mouth 20*a* adjacent the front surface 10 with such a diameter that the projection 19 is disposed in the mouth 20*a* with minimal play. The surface portion of the cavity 20 adjacent the mouth 20*a* is frustoconical and diverges inwardly.

To maintain the conical surface 17 against the flat front surface 18 of the crank 10, a helical expansion spring 21 is provided. The spring 21 is held by screws 22 and 23 which each have a threaded shank which corresponds in diameter with the inside diameter of the spring 21 and which are each screwed into a respective end of the spring. The head of the screw 22 engages a bearing surface 24 provided on the crank and the head of the screw 23 engages a bearing surface 25 provided on the arm 14. The spring 21 is under a certain initial tension which causes the conical surface 17 to be urged firmly against the flat surface 18.

Figure 2:
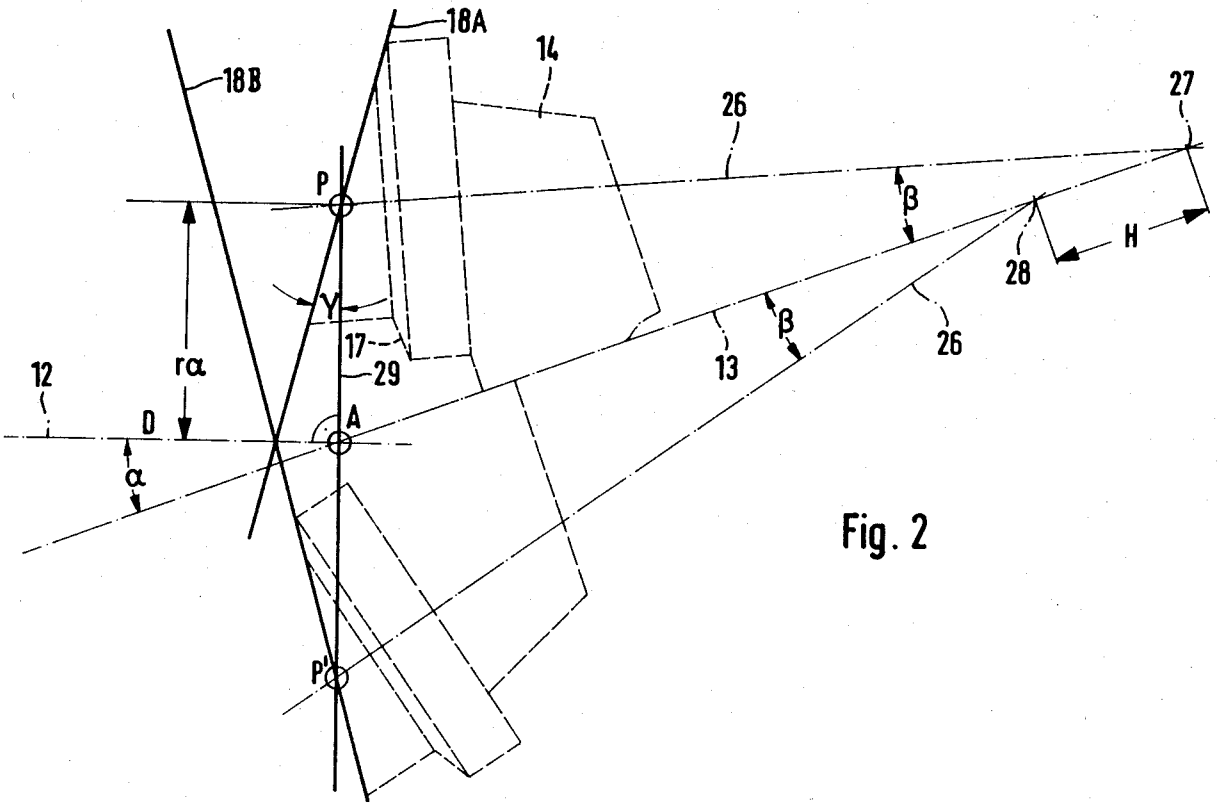
FIG. 2 diagrammatically illustrates two operational positions of the pump according to FIG. 1.

FIG. 2 illustrates diagrammatically and in an enlarged scale, two operational positions of the arm 14 of the embodiment of FIG. 1, namely the position in which the piston is at its right dead center position in FIG. 1 and the position in which the piston is at its left dead center position. The rolling surface 18 has, in the right dead center position of the piston, the position 18A and, in the left dead center position of the piston, the position 18B. The center axis of the conical surface 17 on the arm 14 is identified with reference numeral 26; it intersects the piston axis 13 in a point 27. In the positions 18A and 18B of the surface 18, the point of intersection of the axis 26 and axis 13 is respectively located at points 27 and 28. The distance between the points 27 and 28 is the axial stroke H of the piston. The center axis 26 defines with the piston axis 13 in both illustrated positions an angle $\beta$.

The connecting line 29 between the points P and P' defines with the plane 18 in both illustrated positions 18A and 18B the angle $\gamma$. The condition $\beta=\gamma$ must be met if a smooth and continuous rolling motion is to take place between the conical surface 17 and the flat surface 18 in a manner so that they always engage along a line of contact.

The radial distance $r\alpha$ from the axis of rotation 12 of the motor shaft to the point at which the axis 26 intersects the plane 18 is the lever arm of the crank. The larger this lever arm, the larger the stroke H for a given value of the angle $\alpha$ between the axes 12 and 13. For a given radius $r\alpha$, the stroke becomes greater as the angle $\alpha$ is increased. The relationships illustrated are those used in practice in the preferred embodiment.

The pump according to FIG. 1 operates as follows. FIG. 1 illustrates the position, in which the piston is in its rightmost position. During a further rotation of the crank 10, the piston is simultaneously rotated and is moved leftwardly in the cylindrical bore 3, causing fluid to be drawn into the bore 3 through the bore 5. The leftward force which is necessary for this suction stroke is transmitted through the spring 21. The spring 21 has such a large initial tension that it is not further expanded under the influence of the mentioned forces, so that during the suction stroke the conical surface 17 remains in firm engagement with the flat surface 18. During the rotation of the crank 10, the cone-shaped surface 17 rolls on the surface 18. The rolling motion is continuous. After a 180° rotation of the crank, half of the circumference of the cone-shaped surface 17 has rolled on the surface 18, as can also be seen from FIG. 2.

After reaching its leftmost position, the piston is simultaneously rotated and moved rightwardly, the rightward movement being effected by the flat surface 18 of the crank 10 urging the conical surface 17 rightwardly. During this pressure or discharge stroke, no elasticity in involved. The rolling operation permits the transfer of large forces without significant slipping and wear of the rolling surfaces. The recess 20 is formed so that the projection 19 of the arm 14 has sufficient freedom of movement. The force for rotation is transmitted to the piston by the engagement of the projection 19 with the edge or mouth 20*a* of the recess 20.

The suction bore 5 communicates with a fluid supply bore 30 via the housing cavity 7. Thus, the cavity 7 is constantly flooded. The conveyed medium therefore serves as a lubricating medium for the rolling surfaces.

The motor 1 is a so-called collimator or slotted-tube motor. The motor 1 contains a pipe 31 which is arranged concentrically in the annular space between the stator coil 32 and the rotor 33. The space 34 within the pipe 31 is flooded with the conveyed medium, because the housing cavity 7 communicates through a hole 35 with the space 34. The conveyed medium thus serves to lubricate the motor bearings 36 and 37. Such an arrangement is extremely strong and does not need any service, so that the pump is well suited for an enclosed installation.

Figure 3:
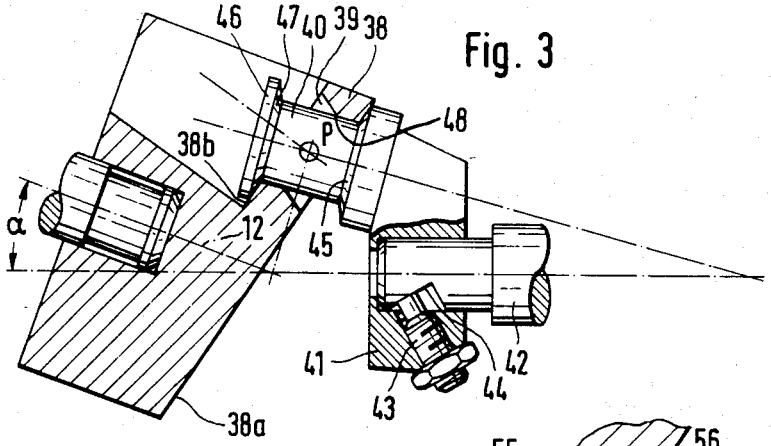
FIG. 3 is a fragmentary sectional side view illustrating a crank and the rear end of a piston which are components of a further embodiment of the pump of FIG. 1, wherein for effecting a retraction of the piston there exists a form-locking connection between the crank and piston.

In the embodiment according to FIG. 3, the piston movement which occurs during the suction stroke is effected by a form-locking engagement between the crank and piston. A hole 39 extends through a wall of the crank 38 and opens into a cavity therein. A cylindrical portion 40 of an arm 41 extends through the hole 39. The arm 41 is secured on the piston 42 in a manner similar to the embodiment according to FIG. 1. In particular, a setscrew 43 is provided which is inclined and presses on an inclined surface 44 provided on a stem of the piston.

A conical surface 45 is provided to the right of the cylindrical surface 40 on the arm 41, which conical surface engages the front surface 38*a* of the crank 38. At the left end of the cylindrical portion 40 there is provided a radially outwardly projecting flange 46 which has a conical surface 47 thereon which cooperates with the flat back side 38*b* of the wall of the crank 38. To facilitate assembly, the flange 46 or both the flange 46 and the cylindrical portion 40 are releasably mounted on the arm 41 in a manner not illustrated in detail in the drawings.

The inner surface of the hole 39 includes two conical sections which meet at reference numeral 48. This seam 48 defines the narrowest point of the opening 39. The diameter at this point is such that the cylindrical section 40 extends through the hole 39 without any significant play.

The pump according to FIG. 3 operates as follows. During the discharge stroke, the power transmission from the motor to the piston occurs in the same manner as has already been described in connection with FIGS. 1 and 2. During the suction stroke, the power transmission occurs through the conical surface 47, which engages the surface 38*b* along a line of contact and rolls on the surface 38*b* as the conical surface 45 rolls on the surface 38*a*. The rotary movement of the piston 42 is effected by forces transmitted from the crank 38 to the cylindrical section 40. This section 40 thus has a duplicate function, namely to contribute to the pulling back of the piston 42 during the suction stroke using flange 46 and to create a form-locking connection for effecting the rotary drive of the piston.

Figure 4:
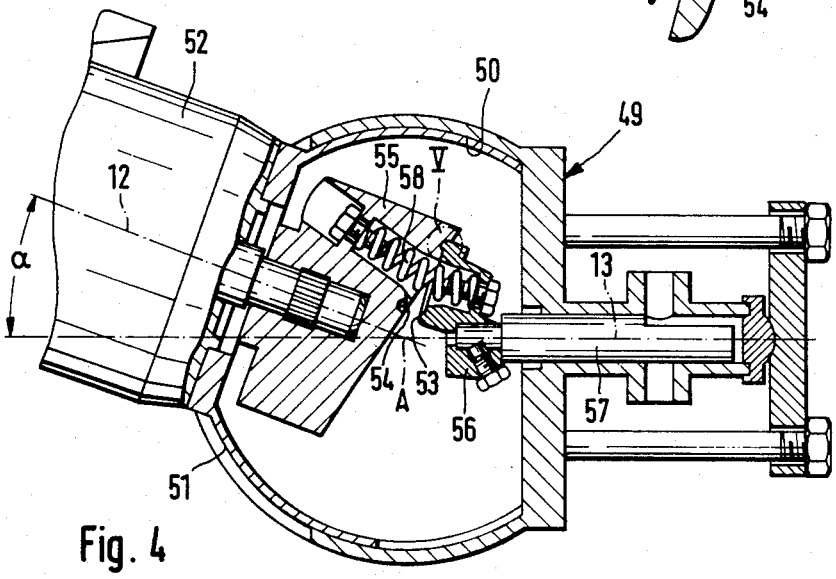
FIG. 4 is a fragmentary longitudinal sectional side view of a further embodiment of the pump of FIG. 1, in which the piston stroke is adjustable.

In the embodiment according to FIG. 4, it is possible to change the angle $\alpha$ between the axis of rotation 12 of the crank and the axis of rotation 13 of the piston, and thus to change the length of the stroke of the piston. A hollow spherical guide surface 50 is provided as the inner surface of the pump housing 49 for this purpose. A spherical surface 51 is provided on a part which is connected fixedly to the drive motor 52, and the surface 51 slidably engages the surface 50. In each angular position of the motor 52 relative to the pump, the crank axis 12 intersects the piston axis 13 at the point A, which is provided at the center point of the spherical surfaces 50 and 51.

Figure 5:
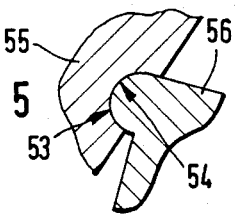
FIG. 5 is a fragmentary sectional side view showing in an enlarged scale the portion of the embodiment of FIG. 4 which is designated by a dash-dotted circle at V.

Since the angle $\alpha$ is variable, a conical surface is less suitable as a rolling surface. Therefore, toric surfaces are provided as rolling surfaces, namely a convex toric rolling surface 53 is provided on the piston and a concave toric rolling surface 54 is provided on the crank 55. The cross sections of these surfaces are illustrated in an enlarged scale in FIG. 5.

The convex toric surface 53 is provided on an arm 56 which is connected fixedly to the piston 57. An expansion spring 58 extends between and has its ends secured to the parts 53 and 54, and is disposed in recesses provided concentrically within the toric surfaces 53 and 54.

The operation is substantially the same as in the case of the pump according to FIG. 1. Here too the discharge stroke forces are transmitted by rolling surfaces and the suction stroke forces are transmitted by the spring 58. The angle $\alpha$ can be varied within wide limits. At the angle $\alpha=0$, the piston stroke is 0, and conveying does not take place. The stroke of the piston increases with an increasing angle $\alpha$. In particular, it is evident from FIG. 5 that the toric surfaces 53 and 54 permit various angular positions between the arm 56 and the crank 55. The engagement of the toric surfaces 53 and 54 results in a form-locking connection which facilitates a rotary-drivelike coupling between the crank 55 and the piston 57. Thus, a special element for effecting the rotary drive need not be provided in this case.

Figure 6:
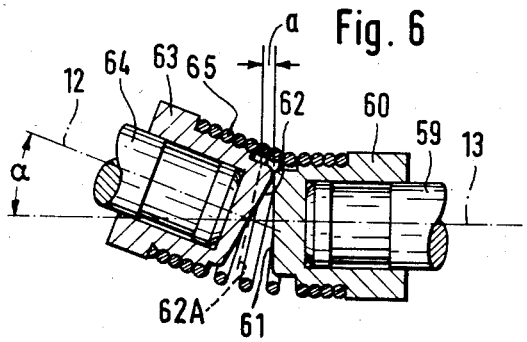
FIG. 6 is a fragmentary sectional side view of a crank and the end of a piston which are components of a further embodiment of the pump of FIG. 1, wherein the rolling surfaces are arranged concentrically with respect to the axes of rotation of the piston and crank.

In the embodiment according to FIG. 6, in contrast to the so far described embodiments, the operative connection is formed by a helical spring which is arranged concentrically with respect to the crank axis and the piston axis. A cap 60 is screwed onto a stem of the piston 59 and has a front surface which serves as a rolling surface. The crank is here formed by a surface 62 which is inclined with respect to the crank axis 12. The surface 62 is provided on a cap 63 which is secured on the drive shaft 64 of the motor.

Both surfaces 61 and 62 are surrounded by the helical expansion or draw spring 65. The caps 60 and 63 are each screwed into a respective end of the spring. Suitable threads are provided for this purpose on the external surfaces of the caps. The spring 65 has the task to pull the two parts 60 and 63 toward one another and also the task to transfer torque from the part 63 to the part 60 in order to effect the rotary drive of the piston. The torque transfer is achieved by the spring being pulled sufficiently together at all times so that further relative rotation of the caps in response to rotation of shaft 64 is not possible.

From observing FIG. 6, it is clear that, upon rotation of the shaft 64, a back and forth movement of the piston 59 occurs. The piston of the surface 62, after it has rotated 180° from the position shown in solid lines, is shown as a broken line at 62A. The stroke length is thus the distance a in the illustrated configuration. In the embodiments according to FIGS. 1 to 5, the rolling surfaces are annular, but the rolling surfaces 61 and 62 in the embodiment according to FIG. 6 are relatively small surfaces which do not have openings therein. The embodiment according to FIG. 6 is suited particularly for small piston strokes and as a whole for small pump throughputs, while the other embodiments are suited for larger strokes and larger throughputs. For pumps in which large forces occur during the suction stroke, the embodiment according to FIG. 3 is particularly suitable.

Figure 7:
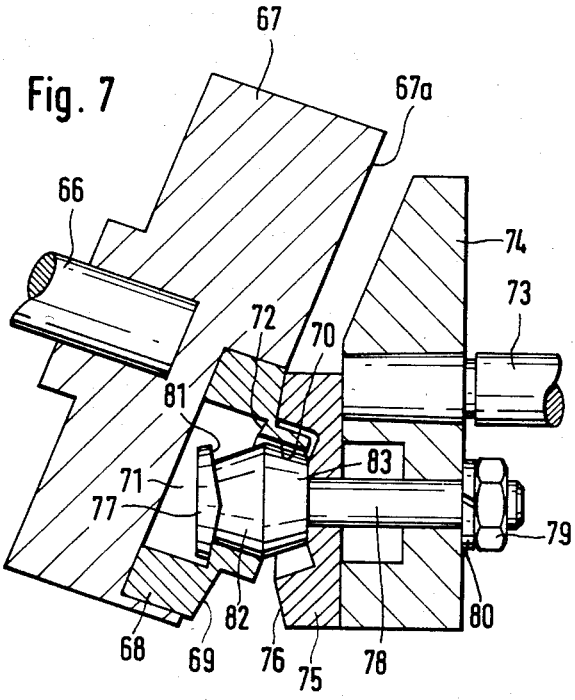
FIG. 7 is a fragmentary sectional side view illustrating a crank and the rear end of a piston in an alternative embodiment of the pump of FIG. 3, wherein both cooperating rolling surfaces are conical surfaces.

The embodiment according to FIG. 7 is similar to the embodiment according to FIG. 3. A crank disk 67 is supported on a motor shaft 66. A hat-shaped part 68 is fixedly connected to the crank disk 67. The hat-shaped part 68 has a portion which projects beyond the front surface 67*a* of the crank disk, and has a rolling surface 69 which encircles the projecting portion and is conical. The hat-shaped part 68 has a central opening 70 which is cylindrical and opens into a cavity 71. A further conical surface 72 is provided on the hat-shaped part 68 around the opening 70 within the cavity 71.

An arm 74, on which a rolling part 75 is fixedly connected, is provided on the pump piston 73. A conical rolling surface 76 is provided on the rolling part 75. The cone angles of the rolling surfaces 69 and 76 are the same.

A part or pin which as a whole is identified with reference numeral 77 is provided on the arm 74. The part 77 has a shank 78 which extends through an opening in the rolling part 75 and the arm 74, onto the end of which shank is screwed a retaining nut 79 which is secured by means of a lock washer 80. The rolling part 75 is held firmly against the arm 74 by the tightening of the nut 79.

The part 77 has at its front end a radial flange with a conical rolling surface 81 thereon which cooperates with the conical rolling surface 72. The conical surfaces 81 and 72 both have the same cone angle. The part 77 has two conical surfaces 82 and 83 on the portion thereof which extends through the opening 70, which conical surfaces 82 and 83 converge away from one another. The cone angles are dimensioned so that, in the positions corresponding to the two end positions of the piston, one of which is illustrated in FIG. 7, each of the conical surfaces 82 and 83 has a portion which is adjacent and parallel to a portion of the surface of the cylindrical opening 70.

The pump according to FIG. 7 operates in principle the same as the pump according to FIG. 3. Through the construction of the cooperating rolling surfaces as conical surfaces having the same cone angles, slipping motions are further reduced, because the surfaces which roll on one another are of equal size. This is not exactly the case during the rolling of a conical surface on a flat annular surface, so that in this case slipping motions occur which are slightly greater.

While according to FIG. 3 a bore with two conical surfaces is provided and cooperates with a cylindrical pin, according to FIG. 7 the bore is cylindrical and the cooperating pin has two conical surfaces. In each case, the same effect is achieved.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A piston pump, comprising: a rotatable piston which is movable back and forth in a cylindrical bore; a rotating crank with which the piston is operatively coupled, the piston axis and the axis of rotation of the crank intersecting one another at an angle; and an annular piston rolling surface which is arranged on the piston and cooperates with an annular crank rolling surface arranged on the crank; wherein the axes of the annular rolling surfaces are inclined relative to one another and the rolling surfaces are urged against one another at a point of contact by forces which occur during the discharge stroke, which contact point upon rotation of the crank moves by rolling along the annular rolling surfaces; wherein the piston and crank are connected by connecting means for causing forces which occur during the suction stroke to be transmitted from the crank to the piston; wherein the piston axis has a constant angle with respect to the crank axis of rotation; and wherein the piston rolling surface is a cone-shaped surface and the crank rolling surface is a flat surface, the cone-shaped piston rolling surface engaging the crank rolling surface along a line of contact which includes the point of contact.

2. The piston pump according to claim 1, wherein said connecting means includes a part which is rigidly connected to the piston, extends through an opening in a wall of the crank and has a flange which engages the back side of the wall of the crank.

3. The piston pump according to claim 1, including form-locking means for effecting a rotary-drive connection between the crank and the piston.

4. The piston pump according to claim 1, wherein the piston is a rotary slide valve which effects fluid flow between an inlet to and an outlet from the cylindrical bore in which the piston is movably supported.

5. The piston pump according to claim 1, wherein said connecting means includes a spring arrangement which pulls the piston toward the crank.

6. The piston pump according to claim 5, wherein the spring arrangement includes a helical expansion spring which is arranged concentrically with respect to the rolling surfaces.

7. A piston pump, comprising: a rotatable piston which is movable back and forth in a cylindrical bore; a rotating crank with which the piston is operatively coupled, the piston axis and the axis of rotation of the crank intersecting one another at an angle; and an annular piston rolling surface which is arranged on the piston and cooperates with an annular crank rolling surface arranged on the crank; wherein the axes of the annular rolling surfaces are inclined relative to one another and the rolling surfaces are urged against one another at a point of contact by forces which occur during the discharge stroke, which contact point upon rotation of the crank moves by rolling along the annular rolling surfaces; wherein the piston and crank are connected by connecting means for causing forces which occur during the suction stroke to be transmitted from the crank to the piston; wherein the piston axis has a constant angle with respect to the crank axis of rotation; and wherein the piston rolling surface and the crank rolling surface are conical surfaces which engage one another along a line of contact which includes the point of contact.

8. The piston pump according to claim 7, wherein the cone angles of both conical surfaces are equal.

9. The piston pump according to claim 7, wherein said connecting means includes a part which is rigidly connected to the piston, extends through an opening in a wall of the crank, and has a flange which engages the back side of the wall of the crank.

10. The piston pump according to claim 7, including form-locking means for effecting a rotary drive connection between the crank and the piston.

11. The piston pump according to claim 7, wherein the piston is a rotary slide valve which effects fluid flow between an inlet to and an outlet from the cylindrical bore in which the piston is movably supported.

12. A piston pump, comprising: a rotatable piston which is movable back and forth in a cylindrical bore; a rotating crank with which the piston is operatively coupled, the piston axis and the axis of rotation of the crank intersecting one another at an angle; and an annular piston rolling surface which is arranged on the piston and cooperates with an annular crank rolling surface arranged on the crank; wherein the axes of the annular rolling surfaces are inclined relative to one another and the rolling surfaces are urged against one another at a point of contact by forces which occur during the discharge stroke, which contact point upon rotation of the crank moves by rolling along the annular rolling surfaces; wherein the piston and crank are connected by connecting means for causing forces which occur during the suction stroke to be transmitted from the crank to the piston; wherein the piston axis has a constant angle with respect to the crank axis of rotation; wherein said connecting means includes a part which is rigidly connected to the piston, extends through an opening in a wall of the crank and has a flange which engages a back side of the wall of the crank; wherein the back side of the wall of the crank is flat; and wherein the flange has a conical rolling surface which engages the flat back side of the crank along a line of contact which includes the point of contact.

13. The piston pump according to claim 12, including form-locking means for effecting a rotary drive connection between the crank and the piston.

14. The piston pump according to claim 12, wherein the piston is a rotary slide valve which effects fluid flow between an inlet to and an outlet from the cylindrical bore in which the piston is movably supported.

15. A piston pump, comprising: a rotatable piston which is movable back and forth in a cylindrical bore; a rotating crank with which the piston is operatively coupled, the piston axis and the axis of rotation of the crank intersecting one another at an angle; and an annular piston rolling surface which is arranged on the piston and cooperates with an annular crank rolling surface arranged on the crank; wherein the axes of the annular rolling surfaces are inclined relative to one another and the rolling surfaces are urged against one another at a point of contact by forces which occur during the discharge stroke, which contact point upon rotation of the crank moves by rolling along the annular rolling surfaces; wherein the piston and crank are connected by connecting means for causing forces which occur during the suction stroke to be transmitted from the crank to the piston; wherein the piston axis has a constant angle with respect to the crank axis of rotation; wherein said connecting means includes a part which is rigidly connected to the piston, extends through an opening in a wall of the crank and has a flange which engages the back side of the wall of the crank; and wherein the flange has a conical rolling surface which engages a conical surface provided on the back side of the wall of the crank.

16. The piston pump according to claim 15, wherein the conical surfaces on the flange and the back wall of the crank have equal cone angles.

17. The piston pump according to claim 15, including form-locking means for effecting a rotary drive connection between the crank and the piston.

18. The piston pump according to claim 15, wherein the piston is a rotary slide valve which effects fluid flow between an inlet to and an outlet from the cylindrical bore in which the piston is movably supported.

19. A piston pump, comprising: a rotatable piston which is movable back and forth in a cylindrical bore; a rotating crank with which the piston is operatively coupled, the piston axis and the axis of rotation of the crank intersecting one another at an angle; and an annular piston rolling surface which is arranged on the piston and cooperates with an annular crank rolling surface arranged on the crank; wherein the axes of the annular rolling surfaces are inclined relative to one another and the rolling surfaces are urged against one another at a point of contact by forces which occur during the discharge stroke, which contact point upon rotation of the crank moves by rolling along the annular rolling surfaces; wherein the piston and crank are connected by connecting means for causing forces which occur during the suction stroke to be transmitted from the crank to the piston; and including means for effecting a variable angle between the piston axis and the crank axis of rotation, including the rolling surfaces being substantially toric surfaces, one said toric surface being concave and the other being convex, and the cross sections of both toric surfaces being adapted so that between the toric surfaces there is a curved line of contact which includes the point of contact.

20. The piston pump according to claim 19, including coupling means for effecting a rotary-drivelike coupling of the crank and piston, said coupling means including a helical spring which is arranged concentrically with respect to the crank axis and the piston axis.

21. The piston pump according to claim 19, wherein said connecting means includes a spring arrangement which pulls the piston toward the crank.

22. The piston pump according to claim 21, wherein the spring arrangement includes a helical expansion spring which is arranged concentrically with respect to the rolling surfaces.

23. The piston pump according to claim 19, wherein the piston is a rotary slide valve which effects fluid flow between an inlet to and an outlet from the cylindrical bore in which the piston is movably supported.

24. A piston pump, comprising: a rotatable piston which is movable back and forth in a cylindrical bore; a rotating crank with which the piston is operatively coupled, the piston axis and the axis of rotation of the crank intersecting one another at an angle; and an annular piston rolling surface which is arranged on the piston and cooperates with an annular crank rolling surface arranged on the crank; wherein the axes of the annular rolling surfaces are inclined relative to one another and the rolling surfaces are urged against one another at a point of contact by forces which occur during the discharge stroke, which contact point upon rotation of the crank moves by rolling along the annular rolling surfaces; wherein the piston and crank are connected by connecting means for causing forces which occur during the suction stroke to be transmitted from the crank to the piston; wherein a coupling piece is provided on a stem of the piston and projects generally radially from the stem of the piston; and wherein the coupling piece is secured on the piston stem by a screw which is provided on the coupling piece, the axis of the screw defining an acute angle with the piston axis and engaging a pressure surface which is provided on the piston stem and which is oriented at a right angle with respect to the screw axis, so that a force component is created which urges the piston and the coupling piece toward each other.

25. The piston pump according to claim 24, wherein said connecting means includes a part which is rigidly connected to the coupling piece, extends through an opening in a wall of the crank, and has a flange which engages a back side of the wall of the crank.

26. The piston pump according to claim 24, including form-locking means for effecting a rotary-drive connection between the crank and the piston.

27. The piston pump according to claim 24, wherein the piston is a rotary slide valve which effects fluid flow between an inlet to and an outlet from the cylindrical bore in which the piston is movably supported.

* * * * *